US006619841B2

(12) United States Patent
Lenz

(10) Patent No.: US 6,619,841 B2
(45) Date of Patent: Sep. 16, 2003

(54) FLUID-COOLED X-RAY TUBE

(75) Inventor: Eberhard Lenz, Erlangen (DE)

(73) Assignee: Siemens Aktiengesellschaft, Münich (DE)

( * ) Notice: Subject to any disclaimer, the term of this patent is extended or adjusted under 35 U.S.C. 154(b) by 0 days.

(21) Appl. No.: 10/117,381

(22) Filed: Apr. 5, 2002

(65) Prior Publication Data

US 2002/0163995 A1 Nov. 7, 2002

(30) Foreign Application Priority Data

Apr. 5, 2001 (DE) ..... 101 17 027

(51) Int. Cl.[7] ..... H01J 35/10
(52) U.S. Cl. ..... 378/200; 378/130; 378/199
(58) Field of Search ..... 378/200, 141, 378/199, 130

(56) References Cited

U.S. PATENT DOCUMENTS 4,911,232 A * 3/1990 Colvin et al. ..... 165/104.17
5,222,118 A * 6/1993 Gerth ..... 62/265
6,419,389 B1 * 7/2002 Fuchs et al. ..... 378/199

* cited by examiner

*Primary Examiner*—Drew A. Dunn
*Assistant Examiner*—Courtney Thomas
(74) *Attorney, Agent, or Firm*—Schiff Hardin & Waite

(57) ABSTRACT

A fluid-cooled x-ray tube has a closed coolant circuit in which coolant circulates for the elimination of the generated heat. In order to improve the cooling capacity, micro-capsules are added to the coolant that contain a phase-change material (PCM). The micro-capsules have a size of approximately 5 $\mu$m through 20 $\mu$m in diameter.

4 Claims, 1 Drawing Sheet

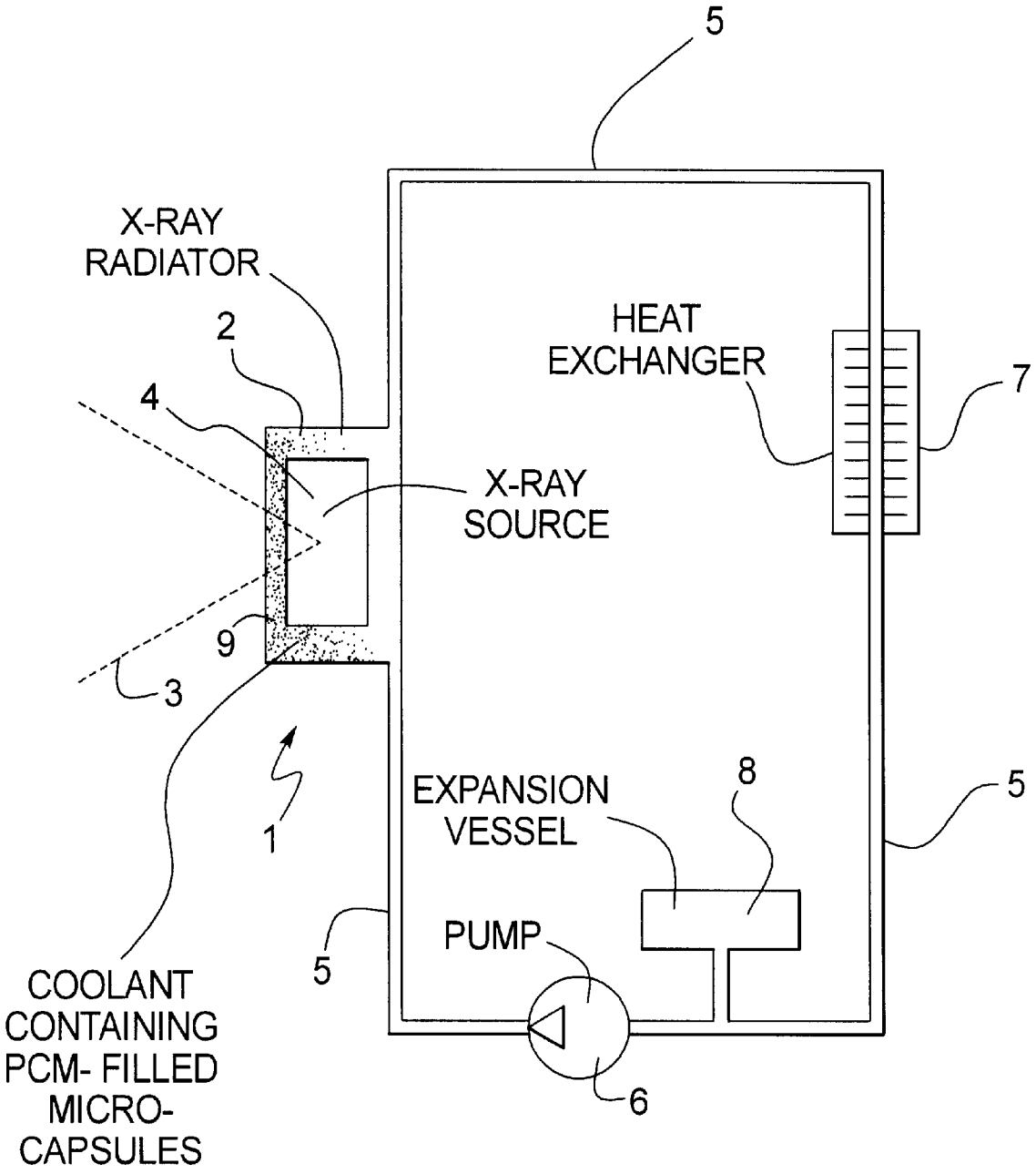
5
X-RAY
RADIATOR
2
4
HEAT
EXCHANGER
7
X-RAY
SOURCE
9
3
1
EXPANSION
VESSEL
8
5
PUMP
5
COOLANT
CONTAINING
PCM- FILLED
MICRO-
CAPSULES
6

FLUID-COOLED X-RAY TUBE

BACKGROUND OF THE INVENTION

1. Field of the Invention

The present invention is directed to a fluid-cooled X-ray tube, of the type wherein coolant flows in a closed cooling circulation path (loop) for the elimination of the generated heat.

2. Description of the Prior Art

In the case of x-ray tubes that, in particular, are provided for utilization in computed tomography systems, there is the desire or requirement to be able to eliminate the heat more efficiently directly from the tube. This desire exists particularly in associating with the need for performance enhancement of the tube, and affects glass bulb x-ray tubes as well as all-metal x-ray tubes, and rotating bulb tubes that are usually cooled with oil.

In glass bulb x-ray tubes, it is mainly the oil carbon deposits that arise at the anode-side glass bulb due to high local heating that have a catalytic influence on the further formation of oil carbon, resulting in the cooling becoming poorer locally in the advanced stages of the tube life, and the x-ray tube can then prematurely fail or the glass bulb can no longer be utilized for recycling due to the increased deposits of carbon residues.

In all-metal x-ray tubes, it is particularly the two smaller diameter passages (bottlenecks) at the cathode neck and the beam exit window that are subject to an especially pronounced heating. Here, as well, there is a greater need for cooling, particularly if it is desired to increase the short-term load of the tube. Due to the structural conditions, however, the cooling capacity cannot be increased without further measures, for example by installing a more powerful pump or by installing specific flow guidance members. The flow resistance would also be increased with the installation of flow guidance members, result in a rise in temperature of the coolant.

In rotating bulb tubes, the extremely high amount of heat at the anode cannot be eliminated rapidly enough by a direct transfer (heat flow) to the oil cooler that is usually present. The quantity of oil is usually limited due to space and weight reasons and therefore cannot be adapted to accommodate an increase in power and thus heat. In order to address this problem, attempts have already been made to install a specific intermediate store in the cooling circulation path so as to be able to intermediately store the heat that arises over the short term. Such an intermediate store, however, is a comparatively technologically complicated component, and the increase in weight associated with such a component leads to further problems due to the higher centrifugal forces in CT systems; and these problems have not been adequately solved. Providing an intermediate store also has the further disadvantage that the flow resistance for the oil flowing therethrough would rise and a more powerful oil pump therefore would have to be provided.

SUMMARY OF THE INVENTION

An object of the present invention is to provide a fluid-cooled x-ray tube of the type initially described wherein the cooling performance can be improved without having to accept the indicated disadvantages.

This object is achieved in accordance with the invention in a fluid-cooled x-ray tube wherein the cooling capacity is considerably increased by the employment of a coolant to which latent heat store elements in the form of micro-capsules are added, these co-circulating in the fluid stream of the coolant.

Elements referred to as latent heat storage elements are storage elements that contain a phase-change material, referred to in short below as PCM. Such PCM storage elements are characterized by the phase change material undergoing a phase conversion at a specific limit temperature. During this phase conversion, which ensues upon the application of energy, the temperature of the PCM remains practically constant, since the supplied energy is practically consumed for the phase change. The energy supplied during the phase conversion is thereby intermediately stored in the PCM storage elements and is in turn released upon reversal of the phase conversion. An increase in the temperature of the PCM occurs only after the phase conversion, given a further application of energy.

In the inventive employment, thus, the heat arising in the x-ray tube is intermediately stored in the PCM storage elements over a certain time span. Dependent on the selected material of the PCM and the amount of the PCM storage elements introduced into the coolant, the temperature of the coolant can be kept nearly constant over a specific time segment despite the heat arising in the generation of the x-rays. Compared to conventional measures for cooling an x-ray tube, the rise in temperature of the coolant is greatly retarded, so that the x-ray radiator can be more highly stressed (loaded) over the same operating duration, or the operating duration of the x-radiator can be significantly lengthened given the same load.

Primarily suitable as PCM materials for this purpose are paraffins whose melting temperatures lie between 90° and 112° C. A preferred paraffin PCM has, for example, a limit temperature of approximately 54° C. at which the phase change occurs. As an alternative to paraffin, suitable fatty alcohols, fatty acids, hydrates of sodium carbonate, sodium acetate, calcium chloride and lithium magnesium nitrate also can be suitable.

The micro-capsules advantageously have a size of approximately 5 through 10 $\mu$m, a maximum of approximately 20 through 50 $\mu$m diameter, and are admixed to the coolant in a proportion of approximately 10 volume per percent. The body or the sheath of the capsules is advantageously composed of a polymerized carbon.

With the inventive measures, the heat capacity and thus the cooling capacity can be increased by a multiple. A particular advantage is that a faster elimination of the heat directly at the location at which it is created is achieved due to the constant flow of the PCM storage elements past the components generating the heat. The cooling of the components "on-site" thereby becomes far more efficient than without these PCM storage elements. Another advantage is that the flow-through quantity of the coolant need not be increased for enhancing the cooling capacity. The oil pump that is usually present therefore need not be dimensioned larger.

DESCRIPTION OF THE DRAWING

The single FIGURE schematically illustrates an x-ray radiator connected to a cooling circuit, constructed and operating in accordance with the principles of the present invention.

DESCRIPTION OF THE PREFERRED EMBODIMENTS

An x-ray radiator 2 provided, for example, for a CT system has a housing 2 wherein an x-ray source 4 (such as an x-ray tube) that emits an x-ray beam 3 is arranged. The housing 2 is filled with a suitable cooling and insulating oil that surrounds the x-ray source 4 and is connected via fluid lines 5 to a pump 6 and to a heat exchanger 7 serving as an intermediate store. The x-ray radiator 2, pump 6 and heat exchanger 7 form a closed cooling circuit in which the cooling and insulating oil circulates. An expansion vessel 8 connected to the fluid line 5 and serves in a known way for the acceptance of the cooling and insulating oil that expands as a consequence of being heated.

Inventively, PCM-filled micro-capsules are admixed to the circulating cooling and insulating oil forming coolant containing PCM-filled micro-capsules 9. (In the figure, the micro-capsules are schematically indicated at only a portion of the circulation path, but it will be understood that in micro-capsules are present throughout the coolant.) The micro-capsules themselves are composed of a polymerized carbon and have a size of approximately 5 through 10 $\mu$m. As a result they flow unproblematically through the narrowest passages in the coolant circuit. Dependent on the structural conditions as well on the size and power of the x-ray source 4, large capsules can be provided.

The admixture of micro-capsules advantageously ensues with a volume part of 10%. Insofar as a higher cooling capacity is desired, the proportion of capsules in the oil can be increased.

In the illustrated example, a heat exchanger 7 is provided in the cooling circuit as an intermediate store, but this is not compulsory. Due to the good heat storage of the micro-capsules filled with PCM, the heat exchanger 7 may not be needed.

Even though an oil, for example, transformer oil, is usually employed as the coolant because of its especially good electrical insulating property, it is also possible to use some other coolant, for example water, when the electrical insulation of the x-ray source 4 can be assured in some other way. In the present example, a metal salt can be advantageously employed as the PCM.

Although modifications and changes may be suggested by those skilled in the art, it is in the intention of the inventor to embody within the patent warranted hereon all changes and modifications as reasonably and properly come within the scope of his contribution to the art.

I claim as my invention:

1. An x-ray radiator system comprising:

a housing;

an x-ray tube disposed in an interior of said housing which emits X-rays;

a closed cooling circuit in fluid communication with said interior of said housing containing coolant flowing in said circuit around and interacting with said x-ray tube with said X-rays passing through said coolant; and said coolant containing micro-capsules containing a phase-change material.

2. An x-ray radiator system as claimed in claim 1 wherein each of said micro-capsules has a largest dimension in a range between 5 $\mu$m and 20 $\mu$m.

3. An x-ray radiator system as claimed in claim 1 wherein said micro-capsules comprise approximately 5% through 20% of a volume of said coolant.

4. An x-ray radiator system as claimed in claim 1 wherein said phase-change material is selected from the group consisting of paraffins, fatty alcohols, fatty acids, hydrates of sodium carbonate, sodium acetate, calcium chloride, lithium nitrate and magnesium nitrate.

* * * * *